United States Patent [19]

Muz

[11] Patent Number: 4,913,667

[45] Date of Patent: Apr. 3, 1990

[54] CONNECTOR SYSTEM WITH REPLACEABLE PLUGS

[75] Inventor: Edwin Muz, Reutlingen, Fed. Rep. of Germany

[73] Assignee: NICOLAY GmbH, Fed. Rep. of Germany

[21] Appl. No.: 322,837

[22] Filed: Mar. 8, 1989

[30] Foreign Application Priority Data

Mar. 9, 1988 [DE] Fed. Rep. of Germany ..... 3607645

[51] Int. Cl.[4] ..... H01R 13/62

[52] U.S. Cl. ..... 439/733; 439/680

[58] Field of Search ..... 439/347, 354, 357, 372, 439/607, 680, 701, 733, 368, 391, 418, 417, 578

[56] References Cited

U.S. PATENT DOCUMENTS 4,200,350 4/1980 Zimmerman, Jr. ..... 439/357

4,674,814 6/1987 Hoshino et al. ..... 439/701 X

FOREIGN PATENT DOCUMENTS 3012174 10/1981 Fed. Rep. of Germany .

3522891 1/1987 Fed. Rep. of Germany .

*Primary Examiner*—Z. R. Bilinsky

*Attorney, Agent, or Firm*—Roylance, Abrams, Berdo & Goodman

[57] ABSTRACT

A connector system for electrical conductors has at least one shaft insert member including a plurality of identical connectors arranged equidistant in a row adjacent to one another. Individual plugs are adapted to the connectors, and are housed in a casing adjacent to one another. The individual plugs can be inserted from one end of its casing. A locking mechanism in the form of a strip is provided as a locking element. When locked, the strip is arranged in a slot in the casing, which slot extends across one of the two sides of the casing. The casing sides engage all of the individual plugs. The slot opens into the inside chamber of the casing. Each individual plug is provided with a lock-in recess to receive the part of the locking strip projecting into the inside of the chamber.

9 Claims, 2 Drawing Sheets

CONNECTOR SYSTEM WITH REPLACEABLE PLUGS

BACKGROUND OF THE INVENTION

A known plug connection arrangement of this type, disclosed in West German Pat. No. 30 12 174, comprises a plug housing receiving a predetermined number of individual plugs adjacent to one another to form a multipolar plug. This plug housing has a U-shaped foundation part and a mating U-shaped covering, as viewed in cross section. One arm of the covering is articulated on one arm of the foundation part. The other arm of the covering has a locking projection. When the housing is closed, the locking projection engages a locking groove in the foundation part. The inside of the plug housing is subdivided into adjacent chambers by partition walls of the foundation part. Each chamber can hold one individual plug. On one side wall of each chamber, a strip projects into the chamber as a locking element, and engages in a locking groove provided on the side of the individual plug when the individual plug lies in the chamber.

A disadvantage of this arrangement is the considerable outlay for the plug housing. Additionally, no security mechanism is provided to prevent unpremeditated or inadvertent disconnection of the plug connection.

Another plug connection arrangement, disclosed in West German Pat. No. 35 22 891, comprises individual plugs connected in the area of their two ends by a mounting plate or a holding clip so as to be able to manipulate the individual plugs together and to interchange or exchange them individually in case of emergency. With careless handling, however, the connection may become disconnected. Furthermore, this arrangement of a plug connection has no means to prevent aberrant detachment of the plug connection.

SUMMARY OF THE INVENTION

An object of the present invention is to provide an improved connector system having a socket member and plug member, which plug member has a plurality of individual plugs releasably mounted in a plug housing.

Another object of the present invention is to provide a connector system which is inexpensive and simple to manufacture.

A further object of the present invention is to provide a connector system with individual plugs which can be removed from its plug housing that prevents inadvertent disconnection of the plug connection.

The foregoing objects are obtained by a connector system comprising a socket member, a unitary rectangular housing, individual plugs and a locking strip. The socket member has first connectors arranged in a row equally spaced from each other. The plug housing is open at first and second longitudinal ends thereof, has a slot in one side extending transversely of a longitudinal axis of the plug housing and has an inside chamber. The individual plugs are coupled to the first connectors and are mounted in the plug housing in a row adjacent one another through one of the ends of the plug housing. The plugs project from the first end of the housing to permit their introduction into the socket member. Each of the plugs has an external locking recess. The locking strip is coupled to the plug housing and is movable between locking and unlocking positions. In the locking position the strip is in the slot, projects into the inside chamber and engages the locking recesses of the plugs to secure the plugs against thrusts in longitudinal direction thereof.

A plug housing formed as a casing constructed in one block or piece considerably reduces the outlay or cost compared to a housing having a foundation part and cover, especially since partition walls separating the chambers are eliminated. Also, such casing securely consolidates the individual plugs. Even during improper handling, the individual plugs cannot be disconnected from the plug housing.

All of the individual plugs are secured by means of a locking strip in the plug housing against abrupt thrusts in the lengthwise direction of the plug. This locking strip can also be locked to the plug housing by a snap action lock mechanism. Thus, the outlet or cost for fixing the plugs in the plug housing is low. Additionally, the closing and opening of the locking mechanism can be carried out without difficulty, permitting any individual plug to be exchanged without problem.

Since preferably both the plug housing and the locking mechanism, in the form of a strip, are plastic, the locking strip can be connected by means of a strap or unitary hinge. The strap hinge prevents the locking strip from being detached from the plug housing.

To facilitate correct positioning of the individual plugs in the plug housing, the plug housing and the individual plugs are preferably provided with mating gradations or shoulders. These gradations come into mutual engagement when the individual plugs are positioned correctly in the plug housing.

When the socket member or part has more first connectors then the plug housing has individual plugs, the socket part and the plug housing have correspondingly constructed irregularities of construction. In a simple manner, the irregularities ensure a correct arrangement or alignment of the plugs relative to the first connectors, in one preferred embodiment. The irregularities permit the socket and plug parts to fit together only in the correct arrangement of the individual plugs relative to the first connectors. Since these irregularities of construction can be formed by shaping of the socket part or respectively the plug housing, the additional cost for this additional security is minimal.

Whatever the method or means of combining the individual plugs for their common handling, the separation friction is increased. The separation friction must be overcome so that the plugs can be withdrawn from the first connectors as desired, independently of the security measures against an unintended separation of the plug connection. The handling of the plug connection arrangement is more difficult when relatively great forces must be applied to obtain connection or disconnection of a plug connection.

With a blade stop spring having a free end segment received in plug recesses, a low-force handling of the plug connection arrangement can be attained, as well as good security against any unintended disconnection. Thus, it is especially advantageous that the force which must be applied to overcome the holding force of the locking device is nearly independent of the number of individual plugs being operated simultaneously.

When the socket part must have a shielding plate, the stop spring can be formed from this shielding plate. This further reduces costs. If the shielding plate from which the stop spring is to be made has too high a degree of stiffness, the part of the shielding plate forming the stop spring can be formed with punched out parts. The punched out parts reduce the effective material section of the stop spring, minimizing the stiffness of the stop spring.

Deflection of the stop spring independently of the number and spacing of the individual plugs can be obtained in the simplest manner with the stop spring free end segment being tongue shaped with an angled tab along its entire length, particularly with the angled tab being a stiffening corrugation.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE PREFERRED EMBODIMENT

Figures 1, 2, 3, 4, 6:
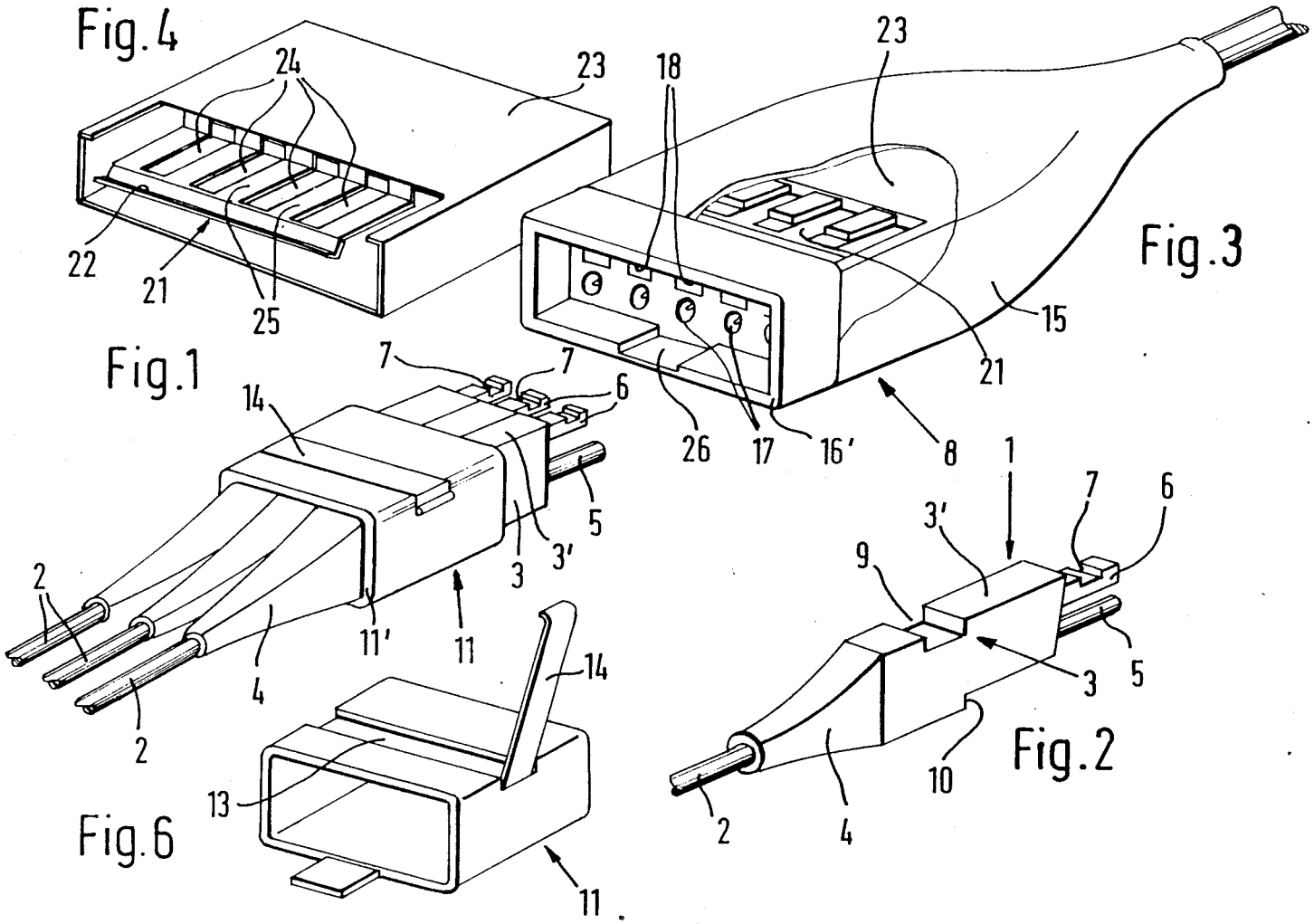
FIG. 1 is a perspective view of a plug part according to the present invention with three individual plugs assembled therein.
FIG. 2 is a perspective view of one individual plug of FIG. 1.
FIG. 3 is a perspective view of a socket part according to the present invention with a portion removed.
FIG. 4 is a perspective, enlarged view of a shielding plate included in the socket part of FIG. 3.
FIG. 6 is a perspective view of the plug housing alone of FIG. 1.

A plug connection system or arrangement for electrical conductors according to the present invention, especially conductors which must be changed from time to time, has individual plugs 1. Each individual plug is provided at the end of an insulated conductor 2. As shown in FIG. 2, individual plugs 1 have a plastic housing 3 which is essentially rectangular. At the back of housing 3, a funnel 4 extends rearwardly and functions as a protective, resilient sleeve for each conductor. Each funnel 4 is formed by tip-stretching the material of the housing.

A cylindrical socket extends axially from the front of housing 3 and has a rear end fitted onto housing 3 and extends lengthwise to the housing. The socket includes a contact member in the form of a liner in cylindrical bore in this exemplary embodiment. At some distance above socket 5, a rod 6 projects from the front of housing 3 parallel to socket 5 and is configured as one piece or unitarily with the housing. The dimensions of rod 6 are approximately identical to those of shaft inset 5. The rod, however in this exemplary embodiment, has a flat top lying in a plane parallel to the top side 3' of housing 3. The top of the rod, as shown in FIGS. 1 and 2, is provided with a transverse groove 7. A second contact member can be arranged in rod 6. Rod 6 can also, as shown in the exemplary embodiment, serve solely for the plugging of individual plug 1 only into one single position or orientation in a socket member 8.

In its top side 3', housing 3 is provided with a rectangular transverse groove 9, which groove serves as a locking-in recess. The bottom of housing 3 forms a downwardly projecting gradation of shoulder 10 spaced at some distance from the front of housing and extending over the entire width of housing 3.

A plug housing or casing 11, in the exemplary embodiment, consolidates three individual plugs 1 in a row lying adjacent to one another forming one plug member. As shown in FIGS. 1 and 6, the plug housing has the shape of a rectangular socket. Plug housing 11 is plastic. Its length is determined such that sufficient lengths of housings 3 of the individual plugs 1 extend or project from the front end of plug housing 11. The narrow width of plug housing 11 is adapted in its shape and size to the common outside contours of the three housings 3 which are arranged adjacent to one another. In this manner, the three individual plugs are held together by plug housing 11 without any play.

Individual plugs 1 are inserted from the back end 11' of plug housing 11, visible in FIG. 1, into this housing. Each of the plugs 1 is positioned with transverse groove 9 opening upward and gradation or shoulder 10 extending downward. Each plug is inserted into plug housing 11 until gradation 10 engages with inwardly projecting gradation or shoulder 12 extending across the entire breadth or width of the bottom of plug housing 11.

When shoulder 10 of housing 3 is in position against shoulder 12 of plug housing 11, transverse groove 9 is aligned with a slot 13 extending through top 3' across its entire width. The breadth of slot 13 is adapted to the breadth of transverse grooves 9 in the axial or longitudinal direction of plug housing 11. At one end of slot 13, a locking strip 14 is connected at one of its ends by means of a strap or integral hinge with housing 3. Strip 14 can be placed in slot 13 without any play. Thus, locking strip 14 also engages or is received within, without any play, grooves 9 of each of the individual plugs 1 and fills these grooves completely.

Figure 5:
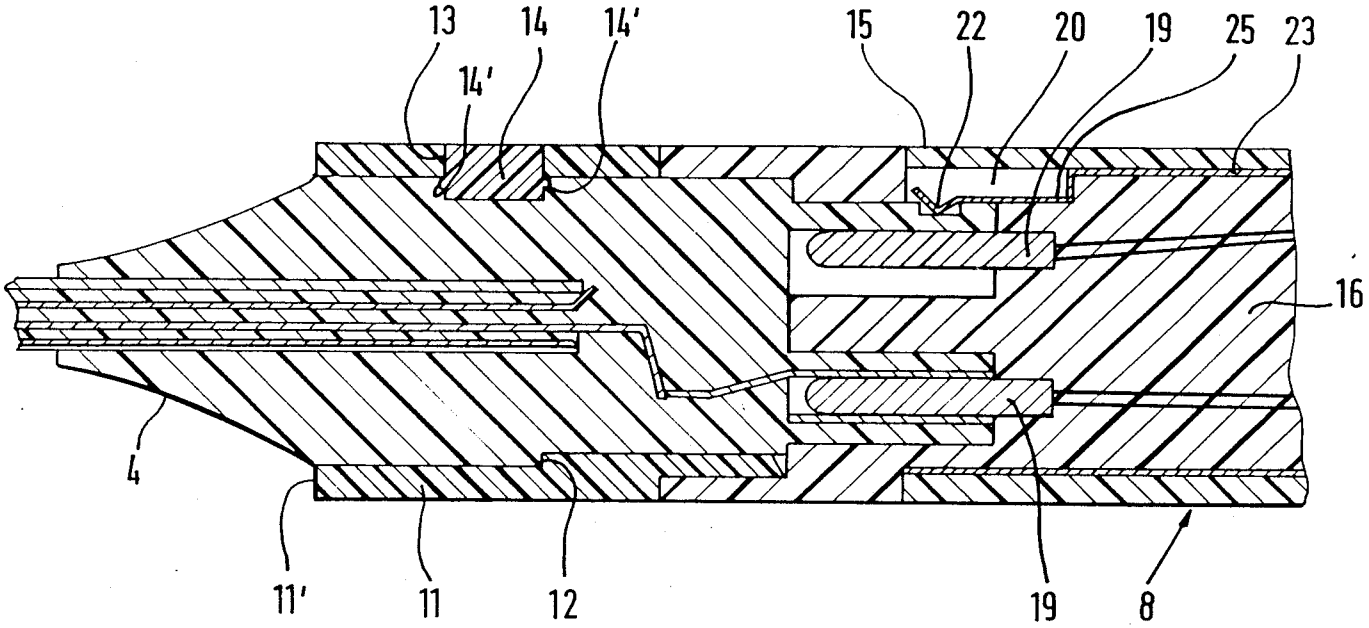
FIG. 5 is an enlarged and partial side elevational view in section of the plug and socket parts of FIGS. 1 and 3 when connected.

FIG. 5 shows that locking strip 14 comprises side protrusions 14', engaging the side dimensions of transverse slot 13, and thus, holding locking strip 14 in its locked position. Although the locking strip may be disconnected and moved to an unlocking position (see FIG. 6), it remains secure against unintended disconnection.

Socket member 8 has a plastic housing 15. The front end of housing 15 is attached to an end segment of an insulation body 16, which end segment projects out of this body 16. This end segment forms a rectangular opening having a contour corresponding to the outside contour of five housings 3 arranged in a row one adjacent to the other in the exemplary embodiment. The depth of this opening from front end 16' is identical to the extension of housings 3 from plug housing 11.

A number of cylindrical passages 17 are formed in insulating body 16. Over cylindrical passages 17, a series or rectangular passages 18 is provided. Passages 17 and 18 open into the opening formed by the end segment of body 16. Passages 17 and 18 are constructed and arranged so that a number of individual plugs 1 corresponding to the number of passages 17 can be inserted into socket part 8. Thus the different contours of passages 17 and 18 guarantee that individual plugs 1 can be introduced only in one certain alignment or orientation.

FIG. 5 shows a contact or connector pin 19 arranged in each of the passages 17 and 18. When the connection is made, these pins penetrate into sockets 5 and rods 6 of the individual plugs 1, and contact the contact bodies which are arranged therein. In the exemplary embodiment, only sockets 5 are provided with electrical contacts.

FIG. 5 also shows that passages 18 are directly connected at their rear segments with a recess 20 is insulating body 16. Recess 20 is arranged over passages 18 and extends over the entire width of insulating body 16. A stop spring 21 lies in recess 20. The free end segment of stop spring 21 is provided with a distinctly defined part 22, extending over the entire width of the tongue-like spring member. The distinctively defined part 22 gives the free end of stop spring 21 the shape of an upward-turned trough with an angular section profile. Part 22 is engaged in transverse slot 9 of each individual plug 1, when the plugs are completely inserted into socket member 8, and secures individual plugs 1 against unintended disconnection of the plug connection.

Stop spring 21 is formed from a segment of a shielding plate 23 surrounding insulating body 16. To adapt the hardness or stiffness of stop spring 21 to the stop spring requirements, stop spring 21 is provided with a plurality of punch-outs 24 as shown in FIG. 4. The punch-outs 24 are arranged one adjacent to the other, so that the free end of stop spring 21, formed by distinctively defined part 22, is a flex-resistant bar extending over the entire width of the punched-out part from a plurality of tongue-shaped projections 25. Projections 25 are bent upward at an angle at their rear or inner ends connected with shielding plate 23. As shown in FIG. 5, projections 25, along portions of their lengths, lie on insulating body 16 when defined part 22 is located in its lock position.

The force required to move stop spring 21 into its release position, by virtue of defined part 22, is independent of whether the force is exerted only at one point or at several points on the free ends of stop spring 21 defined by part 22. In this manner, the force required to connect or disconnect the plug connection is largely independent of the number of individual plugs 1 being operated or moved simultaneously, because this force is determined essentially by stop spring 21.

FIG. 3 shows that the end segment of insulating body 16 forming the front 15' of housing 15 is provided with a groove 26 on its inside surface. Groove 26 extends in the axial or longitudinal direction of the plug. FIG. 6 shows a corresponding tongue-shaped member 27 formed and extending from the front end of plug housing 11. The position of member 27 relative to individual plugs 1 arranged in plug housing 11 permits plugs 1 to be introduced only into the passages 17 and 18 associated with them, even when the number of passages 17 and 18 in socket member 8 is greater than the number of individual plugs 1 in plug housing 11.

While a particular embodiment has been chosen to illustrate the invention, it will be understood by those skilled in the art that various changes and modifications can be made therein without departing from the scope of the invention as defined in the appended claims.

What is claimed is:

1. A connector system, comprising:

a socket member having first connectors arranged in a row equally spaced from each other;

a unitary, rectangular plug housing open at first and second longitudinal ends thereof, said plug housing having a slot in one side extending transversely of a longitudinal axis of said plug housing and having an inside chamber;

individual plugs coupled to said first connectors and mounted in said plug housing in a row adjacent one another through one of said ends of said plug housing, said plugs projecting from said first end of said housing to permit introduction into said socket member, each of said plugs having an external locking recess;

a locking strip coupled to said plug housing and movable between locking and unlocking positions, in said locking position said strip being in said slot, projecting into said inside chamber and engaging said locking recesses of said plugs to secure said plugs against thrusts in longitudinal directions thereof;

a blade stop spring, included as part of said socket member, having a free end segment extending over said first connectors and into an insertion path of said plugs; and lock-in recesses on said plugs engaging said stop spring.

2. A connector system according to claim 1 wherein said locking strip is hinged at one end thereof to said plug housing.

3. A connector system according to claim 1 wherein said plug housing comprises a housing shoulder projecting into said inside chamber on one side thereof and extending transversely of said longitudinal axis at a distance from said one end of said plug housing; and each of said plugs comprises a mating shoulder engaging said housing shoulder.

4. A connector system according to claim 1 wherein said socket member and said plug housing comprise polarizing means for ensuring engagement of said plugs in said socket member in only a single, predetermined alignment with said first connectors.

5. A connector system according to claim 1 wherein said stop spring comprises a unitary portion of a shielding plate surrounding said first connectors in said socket member;

said socket member comprises a socket housing, an insulating body supporting said first connectors and a hollow space between said socket housing and said insulating body, said free end segment being located in said hollow space.

6. A connector system according to claim 5 wherein said free end segment is tongue-shaped, and is reinforced by an angled tab extending along an entire width of said free end segment.

7. A connector system according to claim 6 wherein said angled tap comprises a stiffening corrugation engaging said lock-in recesses.

8. A connector system according to claim 1 wherein electrical conductors are coupled to said plugs and said first connectors.

9. A connector system according to claim 1 wherein said plug housing is formed of plastic.

* * * * *